United States Patent [19]

Mikiya et al.

[11] 4,269,797

[45] May 26, 1981

[54] BUBBLE GENERATOR

[75] Inventors: Toshio Mikiya; Tadahisa Mogaki; Nobuyuki Nozawa, all of Tokyo, Japan

[73] Assignee: Nikki Co., Ltd., Japan

[21] Appl. No.: 157,095

[22] Filed: Jun. 6, 1980

[30] Foreign Application Priority Data

Nov. 22, 1979 [JP] Japan ..... 54-163033[U]

[51] Int. Cl.[3] ..... B01F 3/04

[52] U.S. Cl. ..... 261/122; 4/543; 128/66; 261/62; 261/124

[58] Field of Search ..... 261/62, 122, 124; 4/541-543; 128/66

[56] References Cited

U.S. PATENT DOCUMENTS

| | | | |
|---|---|---|---|
| 1,855,114 | 4/1932 | Pavlov | 128/66 |
| 3,031,685 | 5/1962 | Baumann | 261/124 X |
| 3,178,730 | 4/1965 | Bogar | 261/124 X |
| 3,761,064 | 9/1973 | Selway | 261/62 X |
| 3,814,399 | 6/1974 | Melreit | 261/124 |
| 3,870,040 | 3/1975 | Kulisch | 128/66 |
| 4,048,266 | 9/1977 | Baumann | 261/124 X |
| 4,101,988 | 7/1978 | Sierant | 4/543 |
| 4,122,846 | 10/1978 | Baumann | 128/66 |

FOREIGN PATENT DOCUMENTS

| | | | |
|---|---|---|---|
| 2451503 | 5/1976 | Fed. Rep. of Germany | 4/543 |
| 2713233 | 10/1978 | Fed. Rep. of Germany | 128/66 |

*Primary Examiner*—Richard L. Chiesa

*Attorney, Agent, or Firm*—Ostrolenk, Faber, Gerb & Soffen

[57] ABSTRACT

A bubble generator is comprised of a bubble plate and an adjuster plate slidably coupled to each other, the former being provided with parallel small bubble holes rows and the latter with parallel small slot rows, large slot rows and large bubble hole rows. Mutual sliding between the plates allows three different modes of bubble generation at user's free choice.

6 Claims, 14 Drawing Figures

BUBBLE GENERATOR

BACKGROUND OF THE INVENTION

The present invention relates to a bubble generator, and more particularly relates to an improved construction of a bubble generator used for bubble baths and bubble face cleaners.

Recently, bubble baths and bubble face cleaners have been widely used by ordinary consumers for beauty and medical purposes.

In general bubble generating mechanism in a water bath of the above-described sorts, compressed air generated by a source such as a compressor is conducted to a bubble generator placed on the bottom of the water bath in order to be discharged into the water bath in the form of numerous fine bubbles and such bubbles stimulate the skin of the user placed in the water bath facing the bubble generating face of the bubble generator.

Such a bubble generator is in general comprised of a bubble plate internally defining an air chamber and a hose for connecting the air chamber to a given supply source of compressed air. The bubble generating face of the bubble generator is provided with a number of through bubble holes communicating with the air chamber.

As for the size of bubbles to be generated, it is generally known that smaller bubbles provide larger ultrasonic cleansing effect and larger bubbles provide larger massage effect, both to user's skin.

Conventional bubble generators on market are classified into two types, one for generation of large bubbles and the other for generation of small bubbles. In other words, a bubble generator of one type is generative of bubbles of one size only. Users need to make choice of type on the basis of their preference. When a user wishes to obtain bubbles of different sizes, bubble generators of different types have to be prepared, or replacement of the bubble generating face of a bubble generator has to be practiced. In addition, it is quite impossible with conventional construction for a user to simultaneously obtain bubbles of different sized by using one bubble generator only.

SUMMARY OF THE INVENTION

It is one object of the present invention to provide a bubble generator selectively generative of bubbles of different sizes at users choice without any reduction in total amount of bubbles.

It is another object of the present invention to provide a bubble generator simultaneously generative of bubbles of different sizes without any reduction in total amount of bubbles.

In accordance with the present invention, a bubble generator is comprised of a bubble plate and an adjusted plate slidably coupled to each in order to be registered at any one of three bubbling positions.

The bubble plate is internally provided with an air chamber to be connected to a given supply source of compressed air, and a bubble generating face provided with a number of aligned bubble holes communicating with the air chamber. The bubble holes are arranged in parallel rows which run substantially normal to the sliding direction of one plate relative to another plate. This direction will hereinafter be referred to as "the sliding direction of the plates." The adjuster plate is provided with aligned small slots formed in the one half of its bubble generating face along the sliding direction of the plates. The small slots are arranged in parallel rows which run substantially normal to the sliding direction of the plates. In the same area, bubble holes are arranged in parallel rows between and in parallel to adjacent rows of small slots, which are larger in contour than the bubble holes in the bubble plate. The bubble holes communicate with associated recesses defined by walls for the small slots on the back side of the adjuster plate. The adjuster plate is further provided with aligned large slots formed in the other half of its bubble generating face along the sliding direction of the plates. The large slots are arranged in parallel rows which run substantially normal to the sliding direction of the plates. The center pitches between adjacent rows of the small slots, adjacent rows of the bubble holes, and adjacent rows of the large slots in the adjuster plate are all equal to the center pitch between adjacent rows of the bubble holes in the bubble plate.

Means are preferably provided for registering the plates at any one of the three bubbling positions. More preferably, means are provided for locking the plates in any selected bubbling position.

DESCRIPTION OF THE PREFERRED EMBODIMENT

Figure 1:
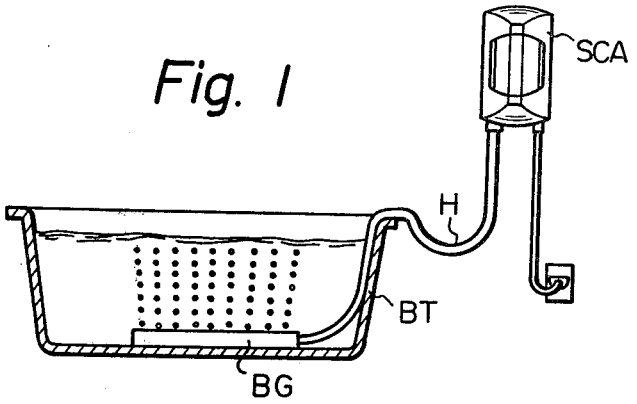
FIG. 1 is a side view, partly in section, of one example of practical use of the bubble generator in accordance with the present invention.

A mode of use of the bubble generator in accordance with the present invention is shown in FIG. 1, in which the bubble generator BG is used for a bath. That is, the bubble generator BG is placed on the inside bottom of a bath tub BT and connected to a source of compressed air SCA by means of a hose H. As compressed air is supplied from the source SCA, the bubble generator BG discharges numerous fine bubbles into the bath.

The bubble generator BG in accordance with the present invention is comprised of a bubble plate 1 and an adjuster plate 2 coupled to each other in a mutually slidable fashion as hereinafter described in more detail.

Figure 2A:
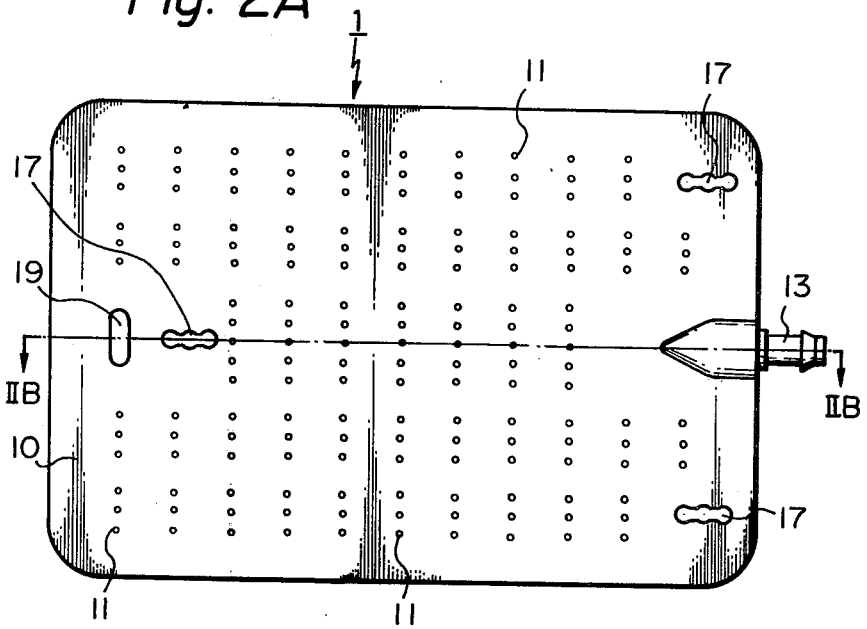
FIG. 2A is a top view of one embodiment of the bubble plate used for the bubble generator in accordance with the present invention.
Figure 2B:
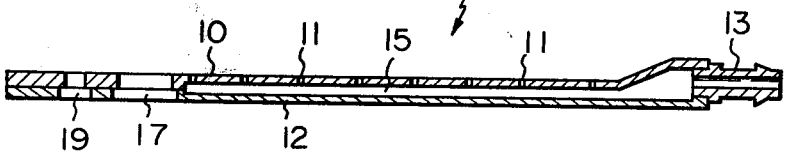
FIG. 2B is a section taken along a line IIB—IIB in FIG. 2A, FIGS. 3A and 3B are top and bottom views of one embodiment of the adjuster plate used in combination with the bubble plate shown in FIGS. 2A and 2B.

One embodiment of the bubble plate 1 is shown in FIGS. 2A and 2B, which generally takes the form of a relatively flat, rectangular and hollow plate. The bubble plate 1 is comprised of separate top and bottom sections 10 and 12 secured in one body to each other, whilst internally defining an air chamber 15. Aligned bubble holes 11 are formed through the top section 10 and arranged in parallel rows which run substantially normal to the sliding direction of the plates. Thus, the air chamber 15 communicates with the exterior of the bubble plate 1 via the bubble holes 11.

The center pitch between adjacent rows of the bubble holes 11 is chosen freely in accordance with need in practical use of the bubble generator BG. The smaller the distance, the larger the number of bubbles to be generated.

At a proper position on one side of the bubble plate, a plug 13 is arranged whilst communicating to the air chamber 15. This plug 13 is used for coupling with the hose H in FIG. 1. Thus, the air chamber 15 is connected to the source of compressed air SCA by means of the plug 13 and the hose H.

At proper positions in the bubble generating face of the bubble plate 1, locking slots 17 extending in the sliding direction of the plates are formed through the top and bottom sections 10 and 12 for the later described snap coupling of the bubble plate 1 with the adjuster plate 2. Each locking slot 17 has three sets of aligned large contour parts connected to each other by intermediate small contour sections. One large contour port is located at the middle of the slot 17 and the other large contour ports on both ends of the slot 17. Likewise, a straight adjuster slot 19 is formed through the top and bottom sections 10 and 12 at a proper position in the bubble generating face of the bubble plate 1. This slot 19 is used for engagement with a later described bubble size adjuster knob on the adjuster plate 2.

When compressed air is supplied to the bubble plate 1 from the source SCA via the elements H and 13, the air chamber 15 is replete with the compressed air which is divided into numerous small air voids and the voids are discharged into the bath in the form of numerous fine bubbles.

Figure 3A:
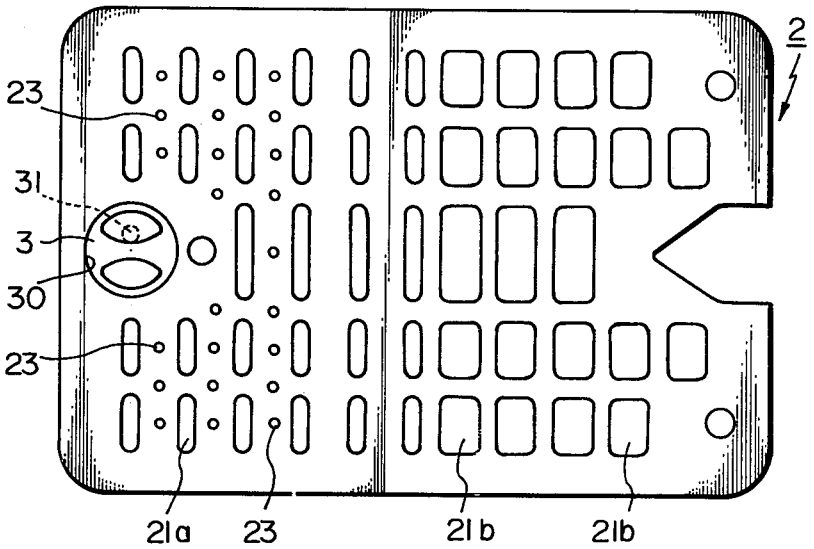
FIG. 3C is a section taken along a line IIIC—IIIC in FIG. 3B.
Figure 3B:
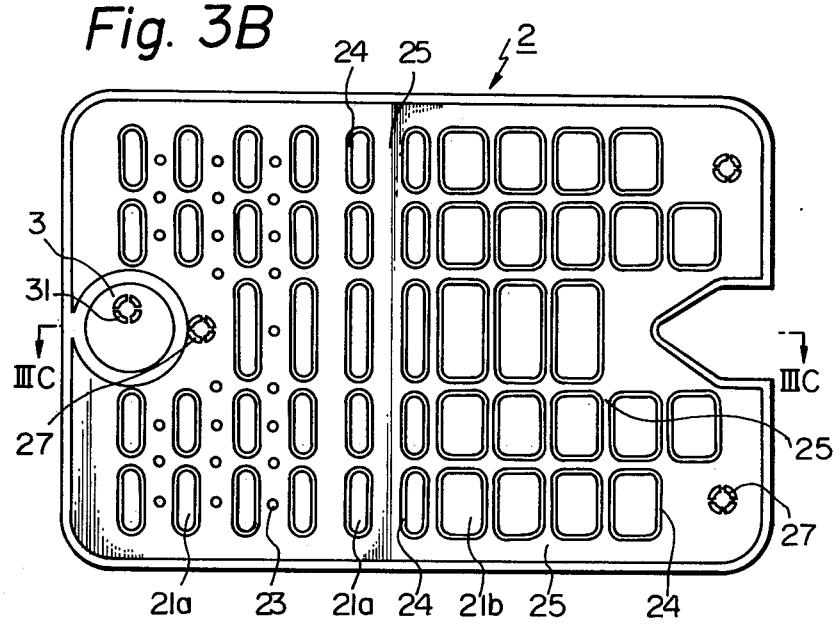
Figure 3C:
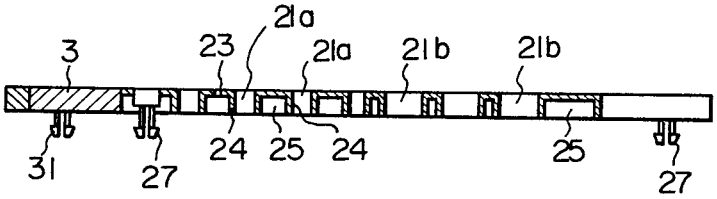

One embodiment of the adjuster plate 2 to be used in combination with such a bubble plate 1 is shown in FIGS. 3A through 3C, which is substantially common in size to the bubble plate 1.

About a position corresponding to the position of the adjuster slot 19 in the bubble plate 1, an adjuster knob 3 is rotatably arranged in the body of the adjuster plate 2 and provided on its back side, i.e. the side opposite to the bubble generating face of the adjuster plate 2, with an integral adjuster projection 31. The snap projection 31 has an offset from the center of rotation of the adjuster knob 3. In the case of this embodiment, the adjuster knob 3 is located near on end of the adjuster plate 2 along the sliding direction of the plates.

In the half of the area close to the adjuster knob 3, the adjuster plate 2 is provided with a number of small slots **21*a* at positions corresponding to the bubble holes 11 in the bubble plate 1. The small slots 21*a* are adapted for generation of small bubbles and arranged in parallel rows. Each small slot 21*a* extends in the direction of the row which it belongs to. The center pitch between adjacent rows of the small slots 21*a* is equal to that of adjacent rows of the bubble holes 11 in the bubble plate 1. Likewise in the half of the area remote from the adjuster knob 3, the adjuster plate 2 is provided with a number of large slots 21*b* at positions corresponding to the bubble holes 11 in the bubble plate 1. The large slots 21*b* are adapted for generation of small bubbles also and are arranged in parallel rows. Each large slot 21*b* extends in the direction of the row which it belongs to. The center pitch between adjacent rows of the large slots 21*b* is equal to that of adjacent rows of the bubble holes 11 in the bubble plate 11**.

The large slots **21*b* are larger in width than the small slots 21*a***.

Between adjacent rows of small slots **21*a* on the side of the adjuster knob 3, a number of bubble holes 23 are formed in rows. Each bubble hole 23 is in communication with a recess 25 which is formed on the backside of the adjuster plate 2 by a pair of walls 24 defining the adjacent small slots 21*a*. The bubble holes 23 in the adjuster plate 2 is larger in contour than the bubble holes 11 in the bubble plate 1**.

At positions corresponding to the locking slots 17 in the bubble plate 1, the adjuster plate 2 is provided on its back side with locking projections 27.

The locking and adjuster projections 27 and 31 have top bulges for snap engagement with the locking and adjuster slots 17 and 19, respectively.

Figure 4:
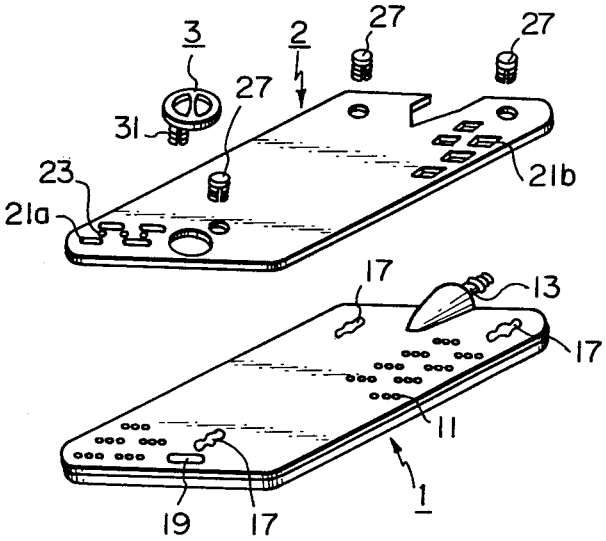
FIG. 4 is a perspective view of the bubble generator in accordance with the present invention in a fully disassembled state.
Figure 5A:
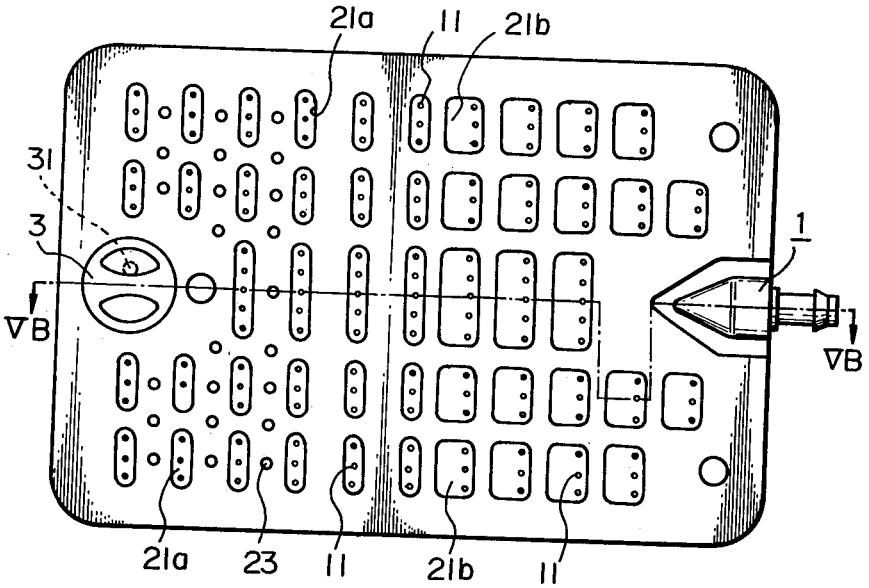
FIG. 5A is a top view of the bubble generator in accordance with the present invention in the assembled state and registered at the first bubbling position.
Figure 5B:
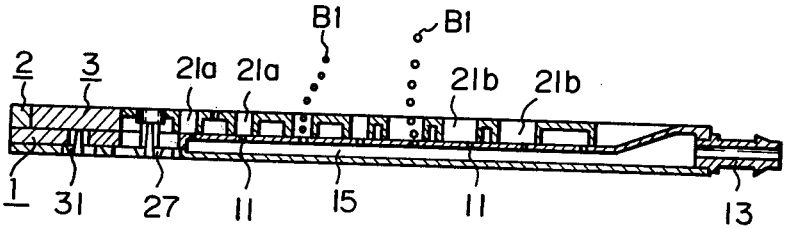
FIG. 5B is a section taken along a line VB—VB in FIG. 5A.

The bubble generator BG made up of the above-described bubble and adjuster plates 1 and 2 is illustrated in a fully disassembled state in FIG. 4 and in the assembled state in FIGS. 5A and 5B. In the assembled state, the locking projections 27 on the adjuster plate 2 are put into snap engagement with the locking slots 17 in the bubble plate 1, and the adjuster projection 31 on the rotary adjuster knob 3 is in engagement with the adjuster slot 19 in the bubble plate 1.

Three different modes of bubble generation are selectively obtainable with the above-described construction of the bubble generator BG.

The first mode of bubble generation is obtained by placing the bubble generator BG under the condition shown in FIGS. 5A and 5B. To this end, the adjuster knob 3 is rotated so that the adjuster projection 31 is registered at the diametral line of the adjuster knob 3 normal to the sliding direction of the plates. Under this condition, each locking projection 27 on the adjuster plate 2 is in engagement with middle large contour port of the corresponding locking slot 17 in the bubble plate 1, and the bubble holes 11 in the bubble plate 1 meet the small and large slots **21*a* and 21*b* in the adjuster plate 2**.

Due to this vertical alignment, small bubbles B1 generated by the bubble holes 11 are discharged into the bath without any hindrance in order to give ultrasonic cleansing effect to user's skin. This relative position between the plates 1 and 2 is referred to as "the first bubbling position."

Figure 6A:
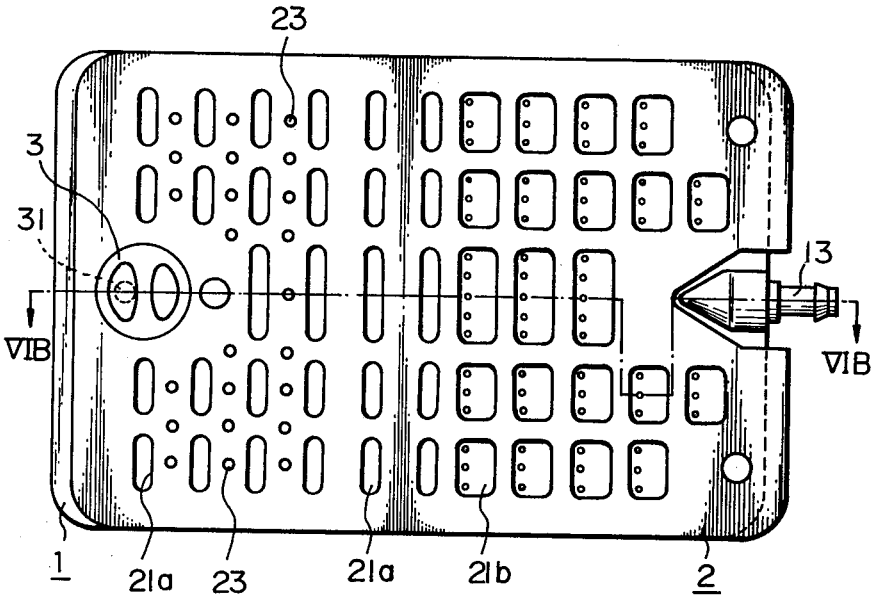
FIG. 6A is a top view of the bubble generator registered at the second bubbling position.
Figure 6B:
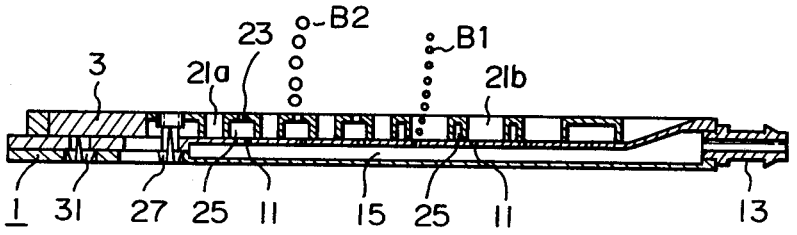
FIG. 6B is a section taken along a line VIB—VIB in FIG. 6A.

The second mode of bubble generation is obtained by placing the bubble generator BG under the condition shown in FIGS. 6A and 6B. To this end, the adjuster knob 3 is rotated over 90° from the position shown in FIG. 5A so that the adjuster projection 31 is registered at the diametral line of the adjuster knob 3 parallel to the sliding direction of the plates on the side remote from the plug 13 i.e. on the left side of the center of rotation in the illustration. By this rotation of the adjuster knob 3, the adjuster plate 2 slides towards the plug 13, i.e. rightwards in the illustration, and each locking projection 27 comes in engagement with the right end large contour port of the corresponding locking slot 17. Under this condition, the bubble holes 11 in the half of the area close to the adjuster knob 3 meet the recesses 25 on the back side of the adjuster plate 2 whereas the bubble holes 11 in the half of the area remote from the adjuster knob 3 meet the large slots **21*b* in the adjuster plate 2. This is due to the difference in width between the two types of slots 21*a* and 21*b***.

Consequently, in the half of the area close to the adjuster knob 3, small bubbles generated by the bubble holes 11 of the bubble plate 1 gather within an associated recess 25 to form large bubbles B2 to be discharged into the bath via the bubble holes 23 in the adjuster plate 2. Concurrently in the half of the area remote from the adjuster knob 3, small bubbles B1 generated by the bubble holes 11 of the bubble plate 1 are discharged via the large slot **21*b*** into the bath without any hindrance.

Thus in the case of the second mode of bubble generation, the small bubbles B1 for ultrasonic cleansing effect are generated together with the large bubbles B2 for massage effect to user's skin. This relative position between the plates 1 and 2 is referred to as "the second bubbling position."

Figure 7A:
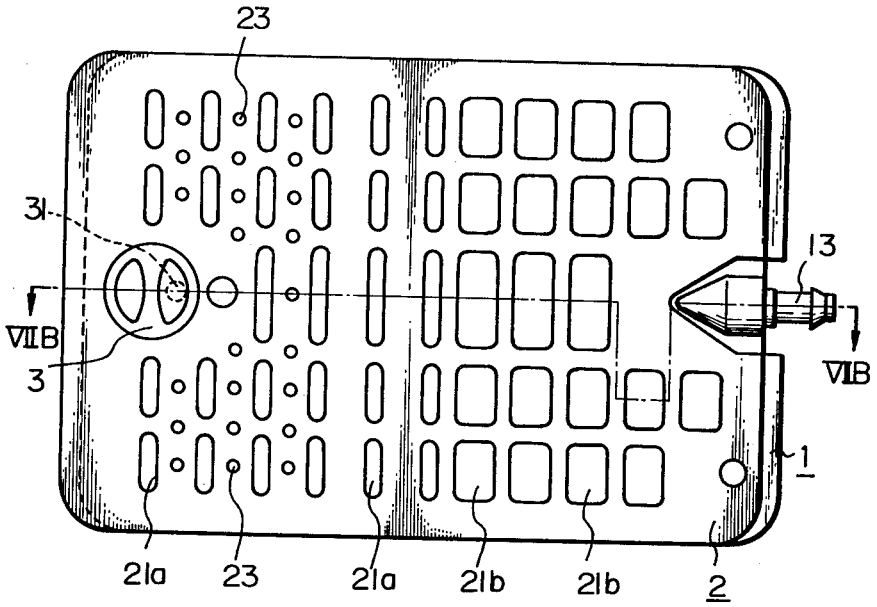
FIG. 7A is a top view of the bubble generator registered at the third bubbling position.
Figure 7B:
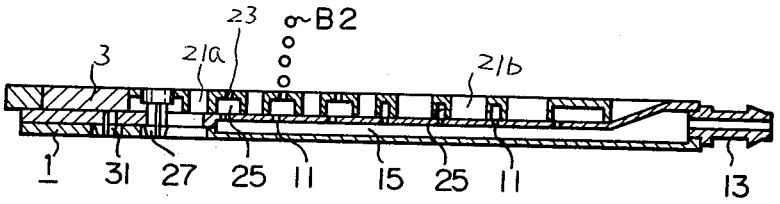
FIG. 7B is a section taken along a line VIIB—VIIB in FIG. 7A.

The third mode of bubble generation is obtained by placing the bubble generator BG under the condition shown in FIGS. 7A and 7B. To this end, the adjuster knob 3 is rotated over 180° from the position shown in FIG. 6A so that the adjuster projection 31 is registered at the diametral line of the adjuster knob 3 parallel to the sliding direction of the plates on the side close to the plug 13, i.e. on the right side of the center of rotation in the illustration. By this rotation of the adjuster plate 2 slides away from the plug 13, i.e. leftwards in the illustration, and each locking projection 27 comes in engagement with the left and large contour port of the corresponding locking slot 17. Under this condition, the bubble holes 11 all meet the recesses 25 on the back side of the adjuster plate 2. In the half of the area close to the adjuster knob 3, presence of the bubble holes 23 allows generation of large bubbles B2 whereas, in the half of the area remote from the adjuster knob 3, the blind construction of the recesses 25 blocks discharge of any bubbles into the bath.

Consequently, only the large bubbles B2 are obtained for massage effect. This relative position between the plates 1 and 2 is referred to as "the third bubbling position."

Figure 8:
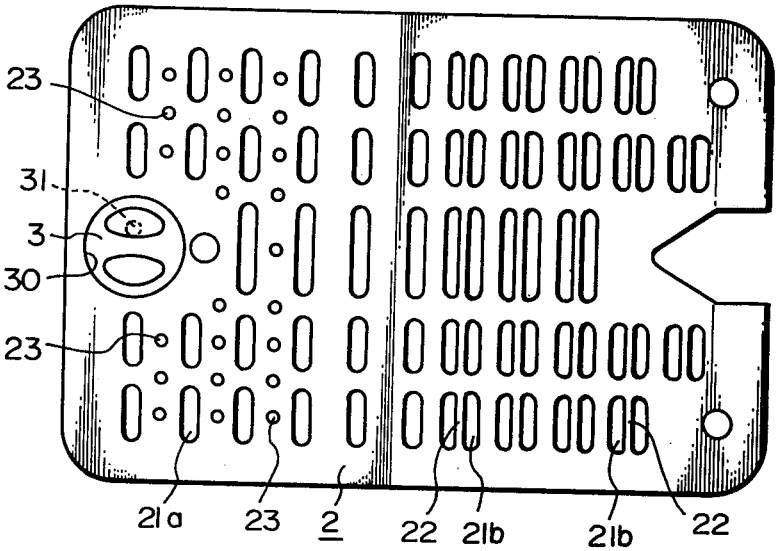
FIG. 8 is a top view of a modification of the adjuster plate shown in FIGS. 3A through 3C.

A modification of the adjuster plate 2 is shown in FIG. 8, in which each large slot **21*b* in the half of the area remote from the adjuster knob 3 is divided into two sections by a thin center rim 22 extending parallel to the rows of bubble holes 11 in the bubble plate 11, each section being roughly similar in contour to the small slots 21*a* in the half of the area close to the adjuster knob 3**. This division provides the bubble generating face of the bubble generator with a uniform appearance.

In accordance with the bubble generator in accordance with the present invention, any one of the above-described three different modes of bubble generation can easily be obtained in accordance with the user's free choice only by munually causing sliding of one plate with respect to another plate. Consequently, one set of bubble generator is able to serve for three different purposes, i.e. ultrasonic cleansing effect, massage effect and the mixture of these effects.

The center pitches between the rows of the small slots **21*a*, between the rows of the large slots 21, and between the rows of the bubble holes 23 in the adjuster plate 2 can be changed in accordance with corresponding change in center pitch of the rows of bubble holes 11 in the bubble plate 1**.

The bubble generator in accordance with the present invention is usable not only for bubble baths but also for bubble face cleaners.

We claim:

1. A bubble generator comprising a bubble plate and an adjuster plate slidably coupled to each other in order to be registered at any one of three different bubbling positions a first bubbling position allowing generation of small bubbles only, a second bubbling position allowing simultaneous generation of small and large bubbles and a third bubbling position allowing generation of large bubbles only;

said bubble plate including an air chamber to be connected to a given supply source of compressed air, and a bubble generating face provided with a number of aligned bubble holes communicating with said air chamber, said bubble holes being arranged in parallel rows which run substantially normal to the sliding direction of the plates at equal center pitch;

said adjuster plate including aligned small slots formed in the one half of its bubble generating face along said sliding direction of the plates, said small slots being larger in width than the largest contour of said bubble holes in said bubble plate, and arranged in parallel rows which run substantially normal to said sliding direction of the plates at equal center pitch, aligned bubble holes arranged in parallel rows between and parallel to adjacent said rows of said small slots, said bubble holes being larger in contour than said bubble holes in said bubble plate, and communicating with associated recesses defined by walls for said small slots on the back side of said adjuster plate, and aligned large slots formed in the other half of said bubble generating face along said sliding direction of the plate, said large slot being larger in width than said smaller slots and arranged in parallel rows which run substantially normal to said sliding direction of the plates at equal center pitch; and center pitches between adjacent rows of said small slots, adjacent rows of said bubble holes and adjacent rows of said large slots in said adjuster plate being all equal to said center pitch between said adjacent rows of said bubble holes in said bubble plate.

2. A bubble generator as claimed in claim 1 further comprising means for registering said bubble and adjuster plates at any one of said three different bubbling positions.

3. A bubble generator as claimed in claim 2 in which said registering means includes a manually operable adjuster knob rotatably inserted in said bubble generating face of said adjuster plate, and an adjuster projection integrally extending from the back side of said adjuster knob at a position having an offset from the center of rotation of said adjuster knob, and in engagement with an adjuster slot formed in said bubble generating face of said bubble plate in a direction substantially normal to said sliding direction of the plates.

4. A bubble generator as claimed in claim 1 or 2 further comprising means for locking said bubble and adjuster plate in any one of said three different bubbling positions.

5. A bubble generator as claimed in claim 4 in which said locking means includes at least one locking projection extending from the back side of said adjuster plate and in snap engagement with any one of three enlarged ports of a locking slot formed in said bubble generating face of said bubble plate in a direction substantially parallel to said sliding direction of plates, each said port corresponding to one of said three different bubbling positions.

6. A bubble generator as claimed in claim 1 in which said bubble holes in said bubble generating face of said bubble plate are arranged in groups each of which includes two or more said bubble holes and corresponds to each said small or large slot in said adjuster plate.

* * * * *